US010940600B2

(12) United States Patent
Hanson et al.

(10) Patent No.: US 10,940,600 B2
(45) Date of Patent: Mar. 9, 2021

(54) DEVICE AND METHOD OF FORMING AN OPENING IN A BABY BOTTLE NIPPLE

(71) Applicant: MACE CORPORATION, Las Vegas, NV (US)

(72) Inventors: Miaohong Hanson, Las Vegas, NV (US); John Hanson, Las Vegas, NV (US); Haibo Huang, Cixi (CN)

(73) Assignee: Mace Corporation, Las Vegas, NV (US)

( * ) Notice: Subject to any disclaimer, the term of this patent is extended or adjusted under 35 U.S.C. 154(b) by 0 days.

(21) Appl. No.: 15/986,644

(22) Filed: May 22, 2018

(65) Prior Publication Data

US 2019/0358844 A1 Nov. 28, 2019

(51) Int. Cl.

| | |
|---|---|
| ***B26D 7/14*** | (2006.01) |
| ***A61J 11/02*** | (2006.01) |
| ***B26F 1/18*** | (2006.01) |
| *B26D 7/24* | (2006.01) |

(52) U.S. Cl.

CPC ..... *B26D 7/14* (2013.01); *A61J 11/02* (2013.01); *B26F 1/18* (2013.01); *B26D 7/24* (2013.01)

(58) Field of Classification Search

CPC ... A61J 11/02; B26D 1/04; B26D 7/01; B26D 7/14; B26D 7/24; B26F 1/18

USPC ..... 83/18, 108, 128, 17; 30/366, 358, 368, 30/162, 335, 163, 329

See application file for complete search history.

(56) References Cited

U.S. PATENT DOCUMENTS

| | | | | |
|---|---|---|---|---|
| 1,584,838 A * | 5/1926 | Brush | ..... | B65D 47/2031 222/490 |
| 1,788,981 A * | 1/1931 | Carpenter | ..... | B26D 7/14 83/18 |
| 2,013,758 A * | 9/1935 | Livermore | ..... | B21D 28/34 72/330 |

(Continued)

FOREIGN PATENT DOCUMENTS

| | | |
|---|---|---|
| CN | 107984539 | 5/2018 |
| EP | 382631 A * | 8/1990 |

(Continued)

*Primary Examiner* — Ghassem Alie

(74) *Attorney, Agent, or Firm* — Weiss & Moy, P.C.; Jeffrey D. Moy

(57) ABSTRACT

A device for forming an opening in a nipple of a baby bottle has a housing having a platform formed on a top surface thereof. a cutting unit is positioned on the platform. The cutting unit moves in an up and down manner forming the opening in the nipple. A holding device on the platform has a base and a cutout formed in a top surface of the base holding the nipple there within. The cutout is formed to hold the nipple so that an area of the nipple where the opening is formed is positioned in a bottom area of the cutout. A slot is formed in a bottom section of the cutout and extending through the base, the slot allowing the cutting unit to penetrate through the nipple and into the slot. The cutting unit contacts and stretches an interior wall of the nipple where the opening is to be formed reducing disfiguration where the opening is formed. When the cutting unit is withdrawn once the interior wall has been penetrated therethrough, the interior wall of the nipple where the opening is formed returning to an initial non-stretched state.

14 Claims, 7 Drawing Sheets

(56) References Cited

U.S. PATENT DOCUMENTS 2,275,525 A * 3/1942 Halmrast ..... B26F 1/02 83/124
2,534,076 A * 12/1950 Nixon ..... A61J 11/009 83/553
3,047,950 A * 8/1962 Stasiuk ..... A61J 11/009 30/368
3,217,574 A * 11/1965 Nauta ..... B26F 1/02 83/108
3,443,000 A * 5/1969 Roger ..... A61J 9/006 264/154
3,741,056 A * 6/1973 Saladin ..... B21D 28/34 83/140
3,973,453 A * 8/1976 Tameo ..... B26F 1/18 83/30
4,526,274 A * 7/1985 Kesselring ..... A61J 11/02 206/231
4,601,710 A * 7/1986 Moll ..... A61B 17/3496 604/164.12
5,410,814 A * 5/1995 Caban ..... A61J 11/001 30/162
5,983,770 A * 11/1999 Helgren ..... A61J 1/1406 264/138
6,177,037 B1 * 1/2001 Mayer ..... A61M 39/04 264/155
6,991,122 B2 * 1/2006 Holley, Jr. ..... A61J 11/001 215/11.1
RE45,665 E * 9/2015 Holley ..... A61J 11/009
10,279,987 B2 * 5/2019 Parrinello ..... B29C 51/266
2008/0115638 A1 * 5/2008 Nalle, III ..... B26D 7/10 83/16
2014/0075764 A1 * 3/2014 Cuba ..... B26F 1/24 30/366
2018/0311911 A1 11/2018 Clores et al.

FOREIGN PATENT DOCUMENTS

GB 774927 A * 5/1957 ..... B21C 37/292
GB 1434696 5/1976
GB 1434696 A * 5/1976 ..... B26F 1/02

* cited by examiner

DEVICE AND METHOD OF FORMING AN OPENING IN A BABY BOTTLE NIPPLE

This patent application is related to U.S. patent application Ser. No. 15/581,241 filed Apr. 28, 2017, entitled "BABY BOTTLE NIPPLE AND METHOD OF FORMING OPENING THEREIN" which is incorporated herein by reference in its entirety.

TECHNICAL FIELD

This disclosure generally relates to a baby bottle nipple, and more particularly, to a system and method for forming an opening in a baby bottle nipple wherein the opening is leak resistant.

BACKGROUND

A baby bottle nipple may allow a baby or infant to drink liquids. These liquids may include formula, breast milk, water, or other fluid. A number of nipples currently exist in the market. Orthodontic nipples, for example, may provide a flattened look while angled nipples may be slanted to tilt into a baby's mouth. Vented nipples may include a tiny hole to allow air to flow while liquid is taken out.

Unfortunately, these nipples have drawbacks. Liquids may accidently be released when, for example, a bottle having the nipple is tipped or dropped. The nipples may also release liquid when a baby is not sucking which may lead to choking. For example, some parents may use a baby bottle to help an infant fall asleep. However, if left unmonitored, once the infant has fallen asleep, the baby bottle nipple may leak any liquids still in the baby bottle. This may cause the infant to choke.

Therefore, it would be desirable to provide a system and method that overcomes the above. The present disclosure provides a system and method for forming an opening in a baby bottle nipple that solves each of the described concerns. Other benefits and advantages will become clear from the disclosure provided herein and those advantages provided above are for illustration.

SUMMARY

This summary is provided to introduce a selection of concepts in a simplified form that are further described below in the DESCRIPTION OF THE DISCLOSURE. This summary is not intended to identify key features of the claimed subject matter, nor is it intended to be used as an aid in determining the scope of the claimed subject matter.

In accordance with one aspect of the present disclosure, a method of forming an opening in a nipple for a baby bottle is provided. The method comprises: inserting the nipple in a holder having an opening formed therein, the nipple positioned within the opening so that an area of the nipple where the opening is to be formed is positioned in a bottom area of the opening, the holder preventing deformation of the nipple in the area where the opening is to be formed; inserting a cutting device in an interior section of the nipple; contacting and stretching an interior wall of the nipple where the opening is to be formed by the cutting device; and penetrating the interior wall of the nipple forming the opening.

In accordance with another aspect of the present disclosure, a device for forming an opening in a nipple of a baby bottle is provided. The device has a housing having a platform formed on a top surface thereof. A cutting unit is placed on the platform, the cutting unit moving in an up and down manner forming the opening in the nipple. A holding device is positioned on the platform. The holding device has a base and a cutout formed in a top surface of the base holding the nipple there within. The cutout is formed to hold the nipple so that an area of the nipple where the opening is formed is positioned in a bottom area of the cutout. A driving unit is provided powering the cutting unit. The cutting unit contacts and stretches an interior wall of the nipple where the opening is to be formed reducing disfiguration where the opening is formed, the cutting unit withdrawing from the interior wall once the interior wall has been penetrated forming the opening, the interior wall of the nipple where the opening is formed returning to an initial non-stretched state.

BRIEF DESCRIPTION OF DRAWINGS

The novel features believed to be characteristic of the disclosure are set forth in the appended claims. In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein:

DESCRIPTION OF THE DISCLOSURE

The foregoing description is provided to enable any person skilled in the relevant art to practice the various embodiments described herein. Various modifications to these embodiments will be readily apparent to those skilled in the relevant art, and generic principles defined herein may be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

The present disclosure relates to a baby bottle nipple and provides a system and method for forming an opening in the baby bottle nipple. More particularly, this disclosure describes a system and method for forming an opening in the baby bottle nipple that reduces or prevents the amount of liquid released due to accidental spillage when a baby is not feeding. In one illustrative embodiment, an opening in the nipple may be formed in a manner that reduces the burrs and/or roughness on the walls through which the opening may be formed. By reducing the number of burrs and/or the roughness on the walls through which the opening may be formed, a firmer seal may be formed between the walls thereby reducing or preventing the amount of liquid released due to accidental spillage when a baby is not feeding.

Figure 1:
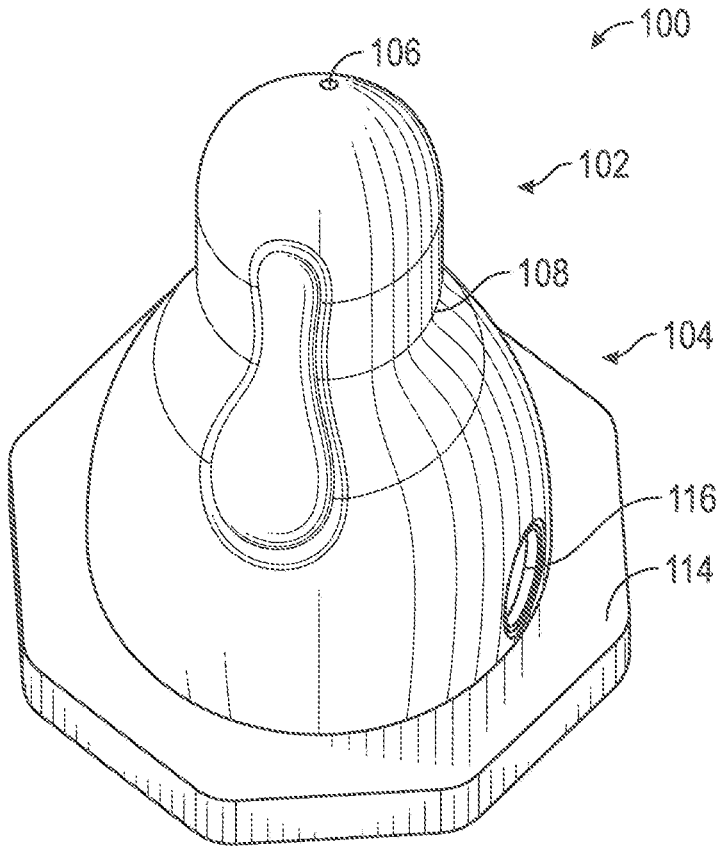
FIG. 1 is a top perspective view of an exemplary nipple formed in accordance with one aspect of the present disclosure.
Figure 2:
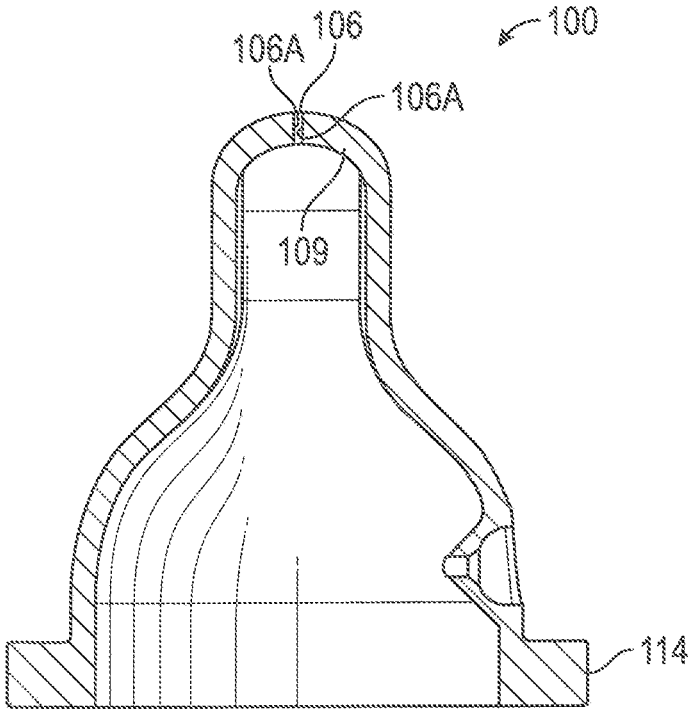
FIG. 2 is a cross-sectional view of the exemplary nipple formed in accordance with one aspect of the present disclosure.
Figure 3:
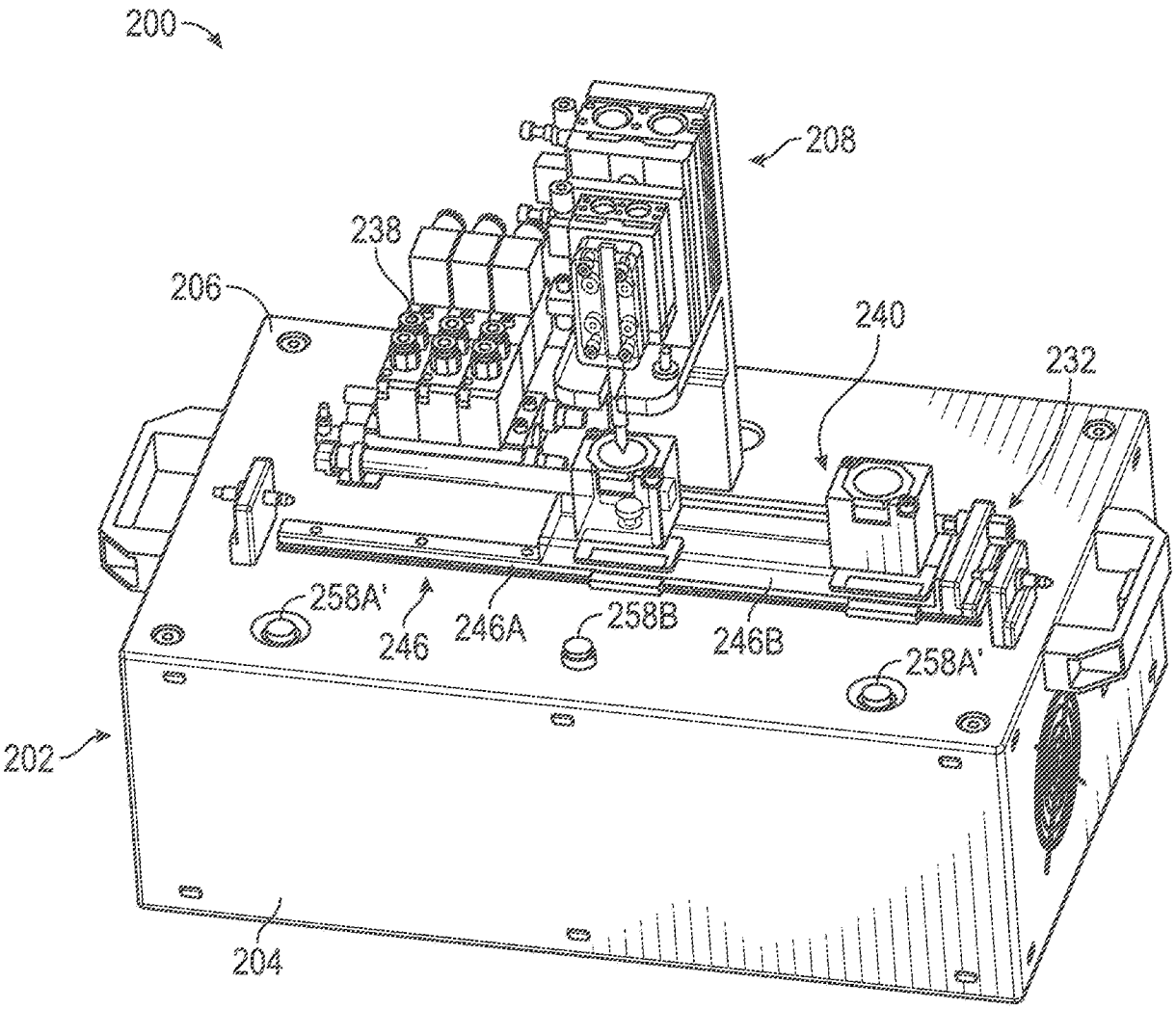
FIG. 3 is a perspective rear view of an exemplary device for forming the opening in the nipple in accordance with one aspect of the present disclosure.
Figure 4:
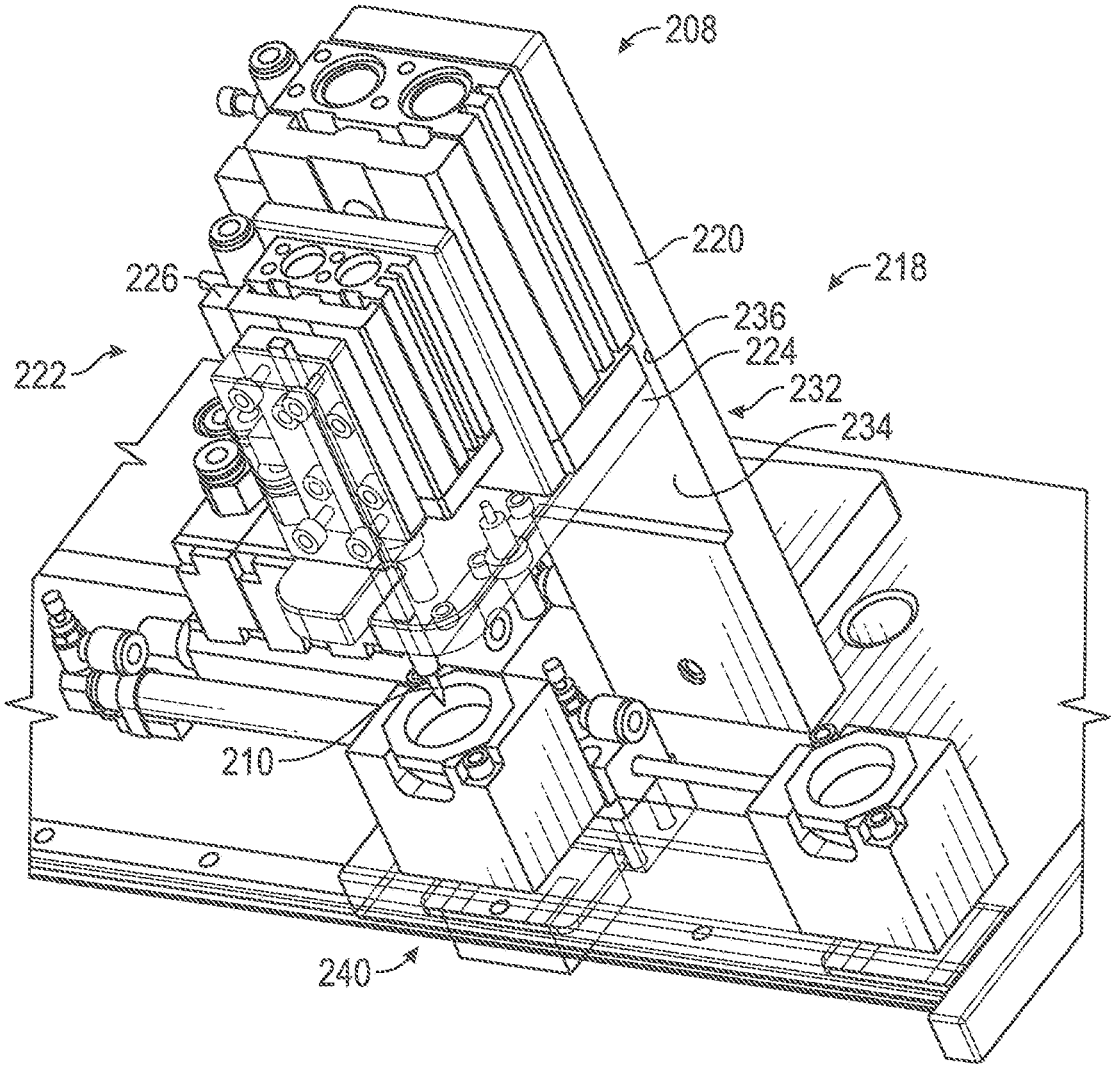
FIG. 4 is a magnified view of an exemplary cutting unit used to form the exemplary nipple in accordance with one aspect of the present disclosure.
Figure 5:
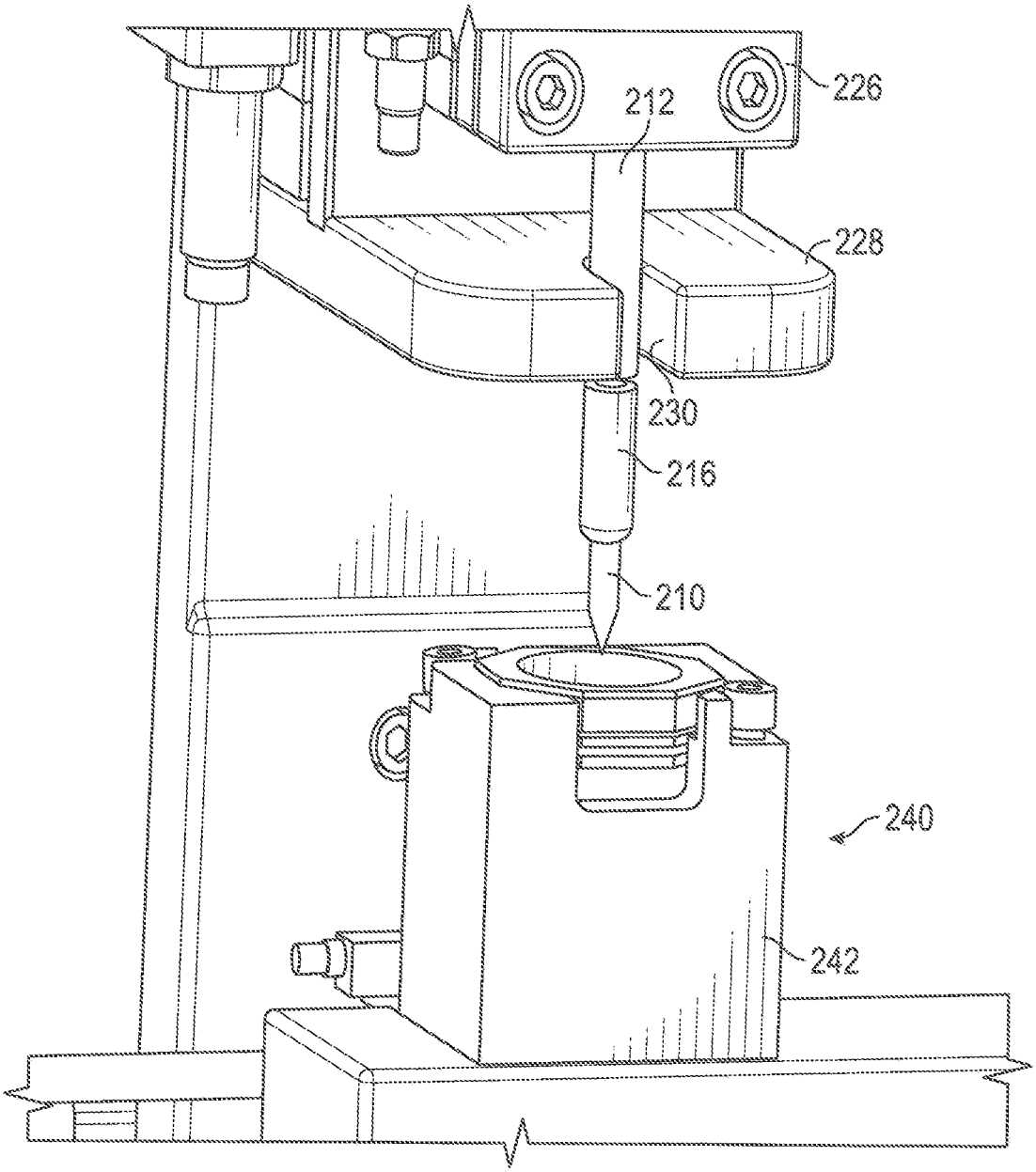
FIG. 5 is a magnified view of an exemplary holding device used by the exemplary device in accordance with one aspect of the present disclosure.

Turning to FIGS. 1-2, an exemplary nipple 100 formed in accordance with one aspect of the present disclosure is provided. The nipple 100 may be part of a baby bottle assembly (not shown).

The nipple 100 may include a higher conical wall section 102, a lower conical wall section 104, and an opening 106 at the top of nipple 100. The higher conical wall section 102 and the lower conical wall section 104 may meet at a neck region 108. The higher conical wall section 102 may be molded above the lower conical wall section 104. Together, the higher conical wall section 102 and the lower conical wall section 104 may form a wall section having an interior chamber 110. The opening 106 may be in communication with the interior chamber 110.

A base portion 114 may extend down from the lower conical wall section 104 of the nipple 100. The base portion 114 of the nipple 100 may fit into a collar (not shown) for securing the nipple 100 to a bottle (not shown). The nipple 100 may be pushed through a bottom portion of the collar such that the base portion 114 rest within an interior section of the collar to secure the nipple 100 into place.

The nipple 100, having the higher conical wall section 102, lower conical wall section 104, base portion 114 and opening 106 at the top may be made of a single piece of elastic material, or multiple pieces of material molded together.

A vent hole 116 may be formed in the lower conical wall section 104. The vent hole 116 may extend into the interior chamber 110 of the nipple 100. The vent hole 116 may allow air to enter the nipple 100 when in use to allow a liquid to flow more smoothly through the nipple 100 and out of the opening 106. The vent hole 120 may be a one-way vent hole 116. This may allow air to enter interior chamber of the nipple 100 when one is sucking on the nipple 100.

When a baby is ready to feed, an applied pressure differential may be made when the baby begins to suck on the nipple 100. The applied pressure may cause the vent hole 116 to open thereby allowing outside air to enter the interior chamber 110 of the nipple 100. The applied pressure may cause the opening 106 to open thereby allowing the liquid from a bottle to flow to the baby. When the sucking action of the baby ceases, the vent hole 116 and the opening 106 may close thereby preventing the liquid from the bottle from leaking out of the vent hole 116 and the opening 106.

The opening 106 may be configured to reduce any leakage out of the opening 106 when pressure is not applied to the nipple 100. The opening 106 may be formed to reduce the number of burrs and/or roughness on the walls 106A through which the opening 106 may be formed. By reducing the number of burrs and/or the roughness on the walls 106A through which the opening 106 is formed, the walls 106A may bond together tighter thereby forming a firmer seal between the walls 106A. The firmer seal may reduce and/or prevent the amount of liquid released due to accidental spillage when a baby is not feeding.

Referring to FIGS. 1-8, a device 200 for forming the opening 106 in the nipple 100 may be disclosed. The device 200 may be designed to reduce the burrs and/or roughness on the walls 106A through which the opening 106 may be formed. The device 200 may have a base unit 202. The base unit 202 may be used to support and hold components of the device 200. In accordance with one embodiment, the base unit 202 may be formed of a housing 204. The housing 204 may be used to store components of the device 200. A platform 206 may be positioned on top of the housing 204. The platform 206 may be used to enclose a top surface of the housing 204 and to support components on a surface thereof.

A cutting unit 208 may be placed on the platform 206. The cutting unit 208 may be configured to form the opening 106 in the nipple 100. The cutting unit 208 may have a cutting blade 210. The cutting blade 210 may be designed to limit the disfiguration in the area of the nipple 100 where the opening 106 may be formed thereby allowing for a smoother cut of the opening 106. As may be seen in FIGS. 6A-8, as cutting blade 210 moves downward within the interior chamber 110 of the nipple 100, the cutting blade 210 may contact and stretch the interior wall 109 of the nipple 100 where the opening 106 is to be formed. By stretching the interior wall 109 during the initial cutting process, the cutting blade 210 limits the disfiguration in the area of the nipple 100 where the opening 106 may be formed. Once the cutting blade 210 penetrates through the nipple 100 to form the opening 106, the cutting blade 210 may be withdrawn. As the cutting blade 210 is withdrawn, the interior wall 109 of the nipple 100 where the opening 106 is formed begins to return to an initial non-stretched state and the walls 106A may bond together tighter thereby forming a firmer seal between the walls 106A. The firmer seal may reduce and/or prevent the amount of liquid released due to accidental spillage when a baby is not feeding.

Figure 6A:
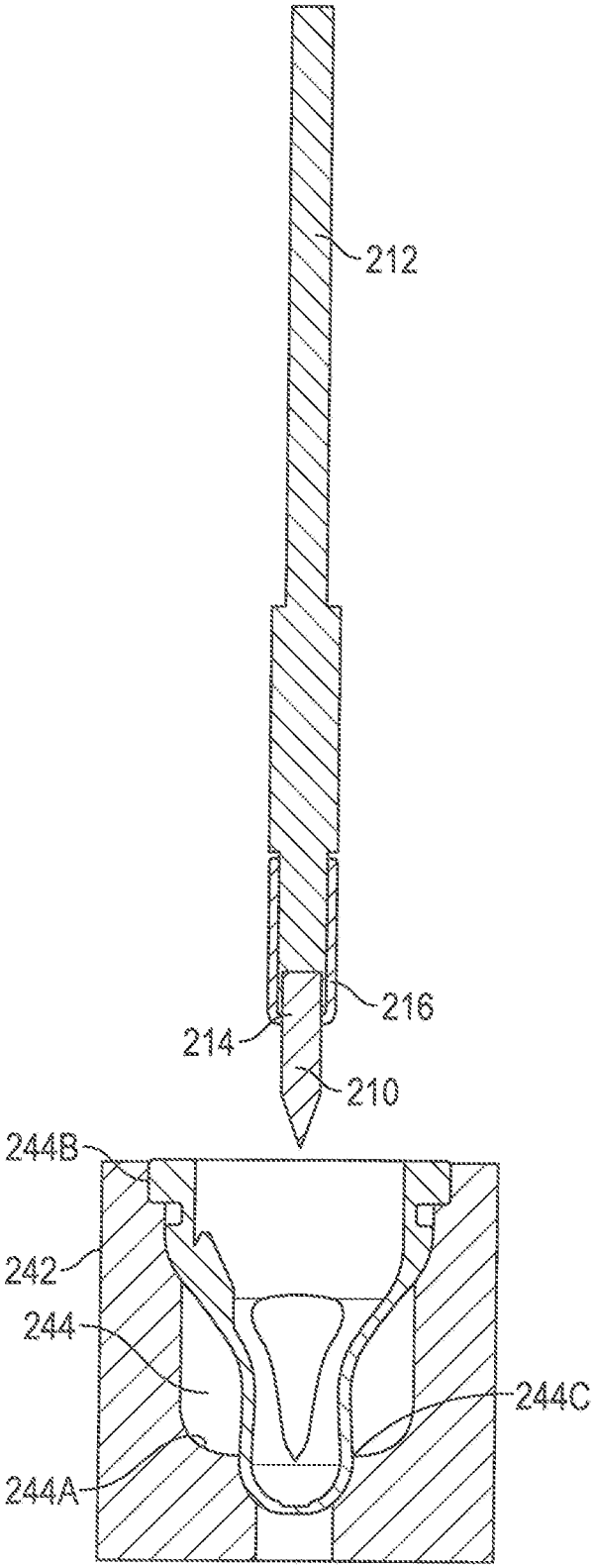
FIG. 6A is a front cross-sectional view of the exemplary holding device and cutting blade in accordance with one aspect of the present disclosure.
Figure 6B:
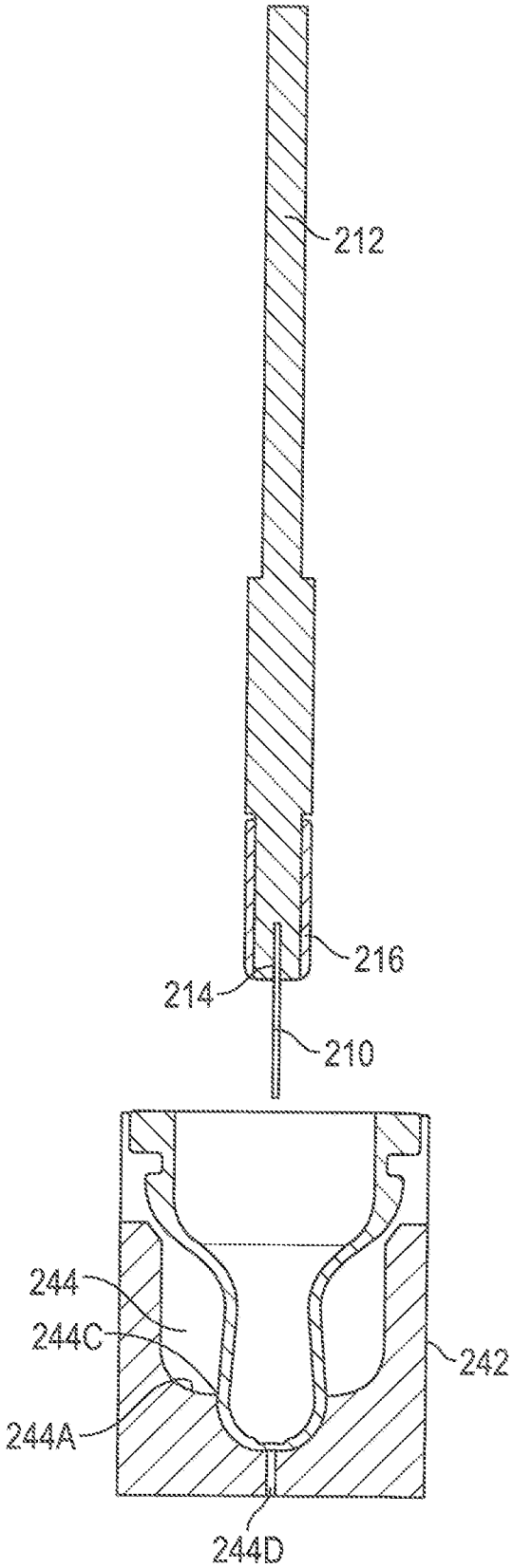
FIG. 6B is a side cross-sectional view of the exemplary holding device and cutting blade in accordance with one aspect of the present disclosure.
Figure 7A:
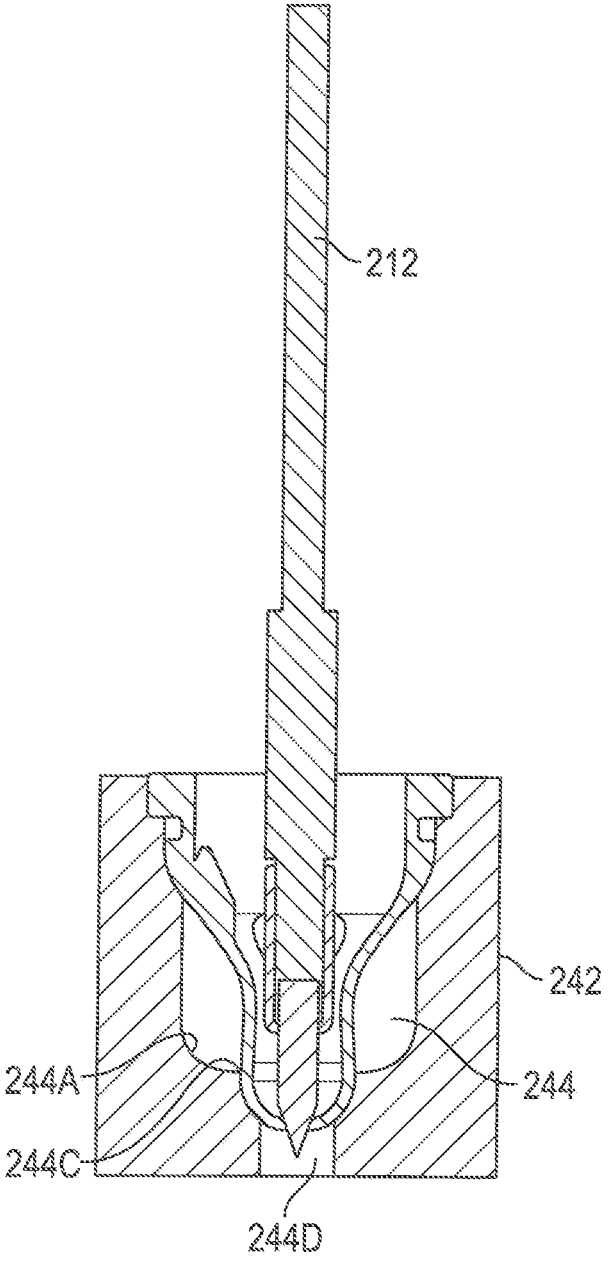
FIG. 7A is a front cross-sectional view of the exemplary holding device and cutting blade in accordance with one aspect of the present disclosure.
Figure 7B:
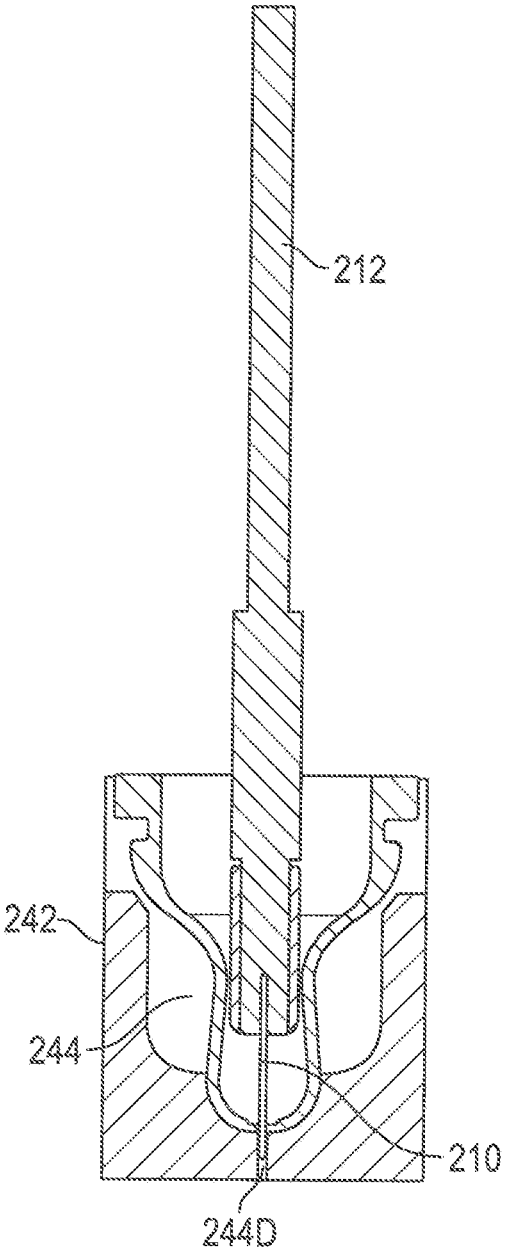
FIG. 7B is a side cross-sectional view of the exemplary holding device and cutting blade in accordance with one aspect of the present disclosure.
Figure 8:
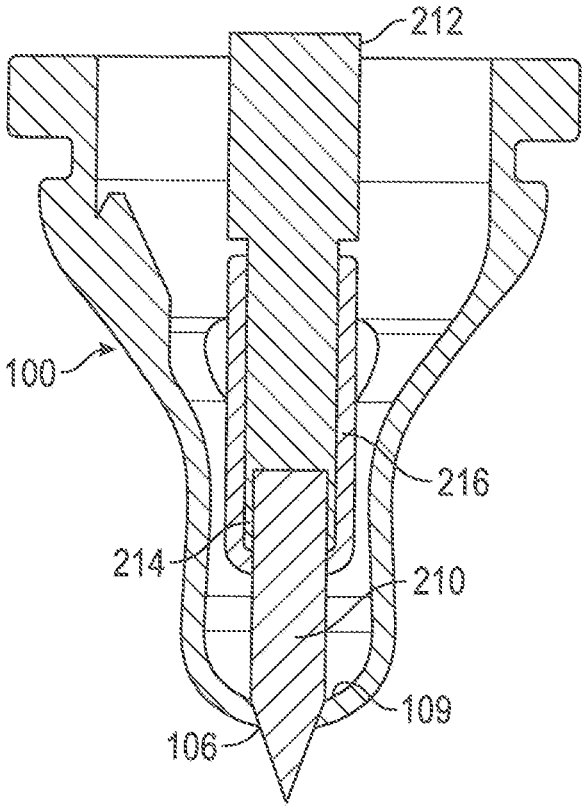
FIG. 8 is a magnified cross-sectional view of the exemplary holding device and cutting blade in accordance with one aspect of the present disclosure.

In accordance with one embodiment, the cutting blade 210 may be triangular in shape having a thin profile as shown in FIGS. 6B, 7B and 8. The triangular shape of the cutting blade 210 allows the cutting blade 210 to stretching the interior wall 109 when the cutting blade 210 contacts and pushes through the interior wall 109 of the nipple 100 during the cutting process.

The cutting unit 208 may have a shaft 212 upon which the cutting blade 210 is attached. A distal end of the shaft 212 may have a slot 214. The slot 214 may be used to house a portion of the cutting blade 210, a remaining section of the cutting blade 210 extending out from the shaft 212. A securing device 216 may be used to secure and hold the cutting blade 210 within the slot 214 of the shaft 212.

The shaft 212 may be coupled to a support device 218 of the cutting unit 208. The support device 218 may be used to hold the shaft 212 in an upright position with the cutting blade 210 extending in a downward position towards the platform 206. The support device 218 may be configured to move the shaft 212 and hence the cutting blade 210 in an up and down motion. The up and down movement of the cutting blade 210 may be used to form the opening 106 in the nipple 100 when the nipple 100 is positioned below the cutting blade 210.

In accordance with one embodiment, the support device 218 may be formed of a base 220. The base 220 may be coupled to and extend up from the platform 206. A sliding unit 222 may be movably coupled to the base 220. The sliding unit 222 may have a body section 224 which is slidable on the base 220. A holder 226 may be attached to the body section 224. The holder 226 may be used to hold the shaft 212 in an upright position with the cutting blade 210 extending in a downward position towards the platform 206. The holder 226 may have any alignment plate 228 which extends from a bottom area of the holder 226. The alignment plate 228 may extend out and may be perpendicular to the holder 226. The alignment plate 228 may have a "U" shaped slot 230 formed therethrough. The "U" shaped slot 230 may be of a same width of the shaft 212. The "U" shaped slot 230 may secure the shaft 212 there within thus preventing the shaft 212 from moving horizontally. This may insure that the cutting blade 210 moves straight down to form the opening 106 in the nipple 100 and prevents scratching or other damage to the interior of the nipple 100.

The sliding unit 222 may be configured to move in an up and down direction on the base 220. A guide 232 may be used to allow the sliding unit 222 to move in an up and down direction on the base 220. In accordance with one embodiment, the guide 232 may have an alignment device 234 such as a track, rail, or other mechanism. The alignment device 234 may be formed on the base 220. A rolling device 236 such as wheels, rollers, ball bearings or similar devices may be formed on the sliding unit 222. The rolling device 236 may engage with the alignment device 234 thereby allowing the sliding unit 222 to move in an up and down direction on the base 220.

The cutting unit 208 may be coupled to a driving device 238. The driving device 238 may be used to move the cutting unit 208 in order to form the opening 106 in the nipple 100. The driving unit 238 may be pneumatic, motorized, hydraulic or similar types of devices. In accordance with one embodiment, the driving device 238 may be coupled to the sliding unit 222. The driving device 238 may be used to move the sliding unit 222 in an up and down manner on the base 220.

A holding device 240 may be used to secure the nipple 100 before and after forming the opening 106. The holding device 240 may limit the amount of disfiguration in the area of the nipple 100 where the opening 106 may be formed thereby allowing for a smoother cut of the opening 106. In accordance with one embodiment, the holding device 240 may be formed of a base 242. In a top area 242A of the base 242, a cutout 244 may be formed. The cutout 244 may be configured to hold the nipple 100 there within, with the area of the nipple 100 where the opening 106 may be formed positioned in a bottom area 244A of the cutout 244. In accordance with one embodiment, the cutout 244 may be tubular in shape. A ridge 244B may be formed around a top perimeter of the cutout 244. The ridge 244B may engage and hold the base portion 114 of the nipple 100. A "U" shape depression 244C may be formed in a bottom area of the cutout 244. When the nipple 100 is positioned within the opening 106 so that the area of the nipple 100 where the opening 106 may be formed is positioned in a bottom area 244A of the cutout 244, the area of the nipple 100 where the opening 106 may be formed may be positioned within and supported by the "U" shape depression 244C thereby reducing deformation during the formation of the opening 106. A slot 244D may be formed in the base 242. The slot 244D may be formed through the "U" shape depression 244C into the base 242. The slot 244D may be of sufficient depth to allow the cutting blade 210 to penetrate the nipple 100 through the interior of the nipple 100 in the area of the nipple 100 where the opening 106 may be formed and not contact the base 242. In accordance with one embodiment, the slot 244D may be formed through the "U" shape depression 244C and out of a bottom area 242A of the base 242.

The holding device 240 may be coupled to a sliding device 246. The sliding device 246 may move the holding device 240 from a first position on a first end (left end and/or right end) of the sliding device 246 to a second central position on the sliding device 246 directly below the cutting unit 208 so that the cutting blade 210 may move straight down to penetrate the nipple 100 through the interior of the nipple 100 in the area of the nipple 100 where the opening 106 may be formed and not contact the base 242 of the holding device 240. In accordance with one embodiment, multiple holding devices 240 may be coupled to the sliding device 246. For example, two holding devices 240 may be coupled to a sliding device 246.

The sliding device 246 may be comprised of a track 246A. The track 246A may run along a width of the platform 206. A plate member 246B may be slidably coupled to the track 246A. The one or more holding devices 240 may be attached to the plate member 246B.

The above is given as an example and should not be seen in a limiting manner. For example, the plate member 246B may be a circular plate. The circular plate may then rotate a plurality of holding devices 240 in a circular motion in order to form the opening 106 in the nipple 100.

The driving device 238 may be coupled to the sliding device 246. The driving device 238 may be used to move the plate member 246B along the track 246A. Alternatively, a separate device other than the driving device 238 may be used to move the plate member 246B along the track 246A.

Figure 9:
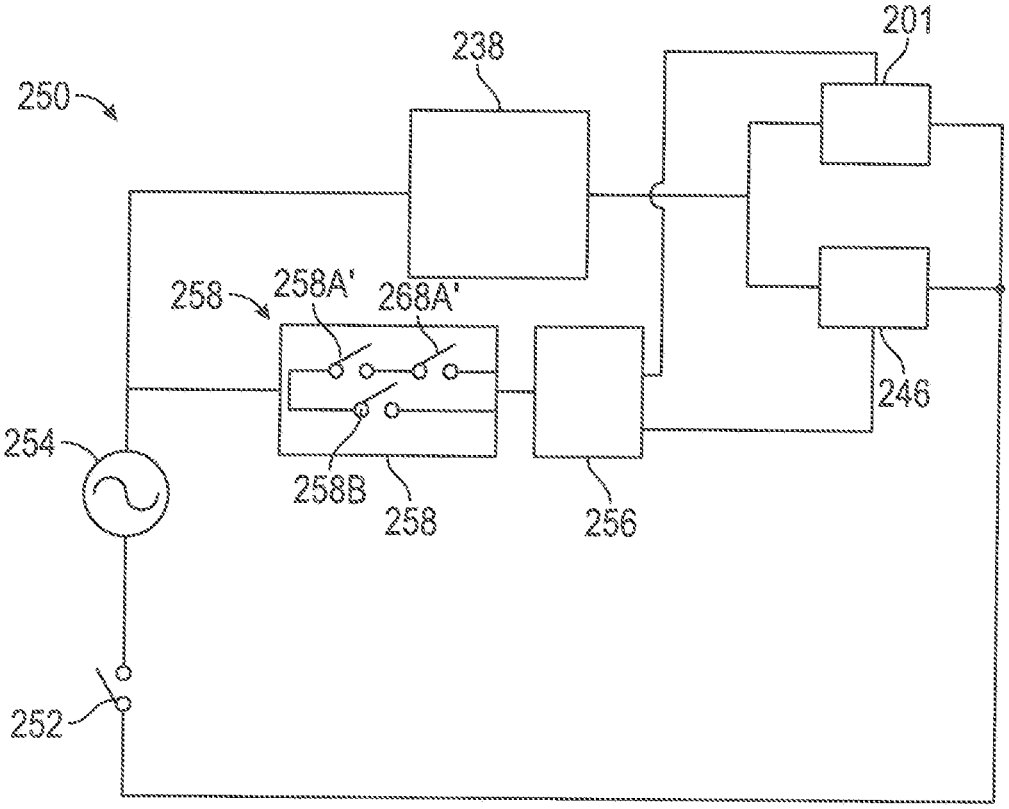
FIG. 9 is a cross-sectional side view of the exemplary nipple in accordance with one aspect of the present disclosure.

The device 200 may be controlled by a control circuit 250 as shown in FIG. 9. The control circuit 250 may have an activation switch 252. The activation switch 252 may be used to activate/deactivate the device 200. Upon activation, a power supply 254 may supply power to components of the device 200. The power supply 254 may provide power to the driving device 238, to a processor circuit 256, a switching circuit 258 and other similar components of the device 200.

The switching circuit 258 may have a first set of switches 258A and a second switch 258B. The first set of switches 258A may be a pair of buttons 258A'. The pair of buttons 258A' may be used to move the holding device 240 from a first position on a first end (left end and/or right end) of the sliding device 246 to a second central position on the sliding device 246 directly below the cutting unit 208 and to move the cutting blade 210 straight down to penetrate the nipple 100 through the interior of the nipple 100 in the area of the nipple 100 where the opening 106 may be formed and not contact the base 242 of the holding device 240 once the holding device 240 is in the proper second central position. In accordance with one embodiment, the pair of buttons 258A' may both need to be depressed in-order to move the holding device 240 from a first position on a first end (left end and/or right end) of the sliding device 246 to a second central position on the sliding device 246 directly below the cutting unit 208 and to move the cutting blade 210 straight down to penetrate the nipple 100 through the interior of the nipple 100 in the area of the nipple 100 where the opening 106 may be formed. This embodiment may help to prevent accidents such as a user being accidentally cut by the cutting unit 208.

The second switch 258B may be an emergency over-ride switch. Upon activation, the second switch 258B may immediately shut off the device 200. In accordance with one embodiment, the second switch 258B may be a push button.

The processor circuit 256 may be used to control the operation of the device 200. The processor circuit 256 may monitor the switching circuit 258 in order to determine what action may be required.

The foregoing description is provided to enable any person skilled in the relevant art to practice the various embodiments described herein. Various modifications to these embodiments will be readily apparent to those skilled in the relevant art, and generic principles defined herein may be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

What is claimed is:

1. A device for forming an opening in a nipple of a baby bottle comprising:

a housing having a platform formed on a top surface thereof;

a cutting unit positioned on the platform, the cutting unit moving in an up and down manner to penetrate the nipple forming the opening through the nipple;

a holding device on the platform, the holding device comprising:

a base; and a cutout formed in a top surface of the base and formed to hold the nipple there within, the cutout formed to hold the nipple so that an area of the nipple where the opening is formed is positioned in a bottom area of the cutout;

a "U" shaped depression formed in a bottom area of the cutout, the "U" shaped depression securing an area of the nipple where the opening is to be formed, the "U" shaped depression supporting and limiting deformation of the area of the nipple where the opening is to be formed when the cutting unit forms the opening;

a slot formed in a bottom section of the "U" shaped depression and extending through the base, the slot allowing the cutting unit to penetrate through the nipple and into the slot; and a driving unit coupled to the cutting unit;

wherein the cutting unit comprises:

a support device coupled to the driving unit;

a shaft, the support device securing the shaft in an upright position and moving the shaft in an up and down motion;

a holding slot formed in a distal end of the shaft:

a cutting blade removably secured to the shaft, wherein the cutting blade has a first section inserted into the holding slot and a remaining section extending down from the distal end of the shaft;

wherein the cutting blade contacts and stretches an interior wall of the nipple where the opening is to be formed while the "U" shaped depression supports and limits disfiguration where the opening is formed, the cutting blade penetrating the interior wall of the nipple where the opening is to be formed and extending into the slot, the cutting blade withdrawing from the interior wall once the interior wall has been penetrated therethrough forming the opening through the nipple, the interior wall of the nipple where the opening is formed returning to an initial non-stretched state.

2. The device of claim 1, comprising a sliding device positioned on the platform moving the holder from a first position to a second position under the cutting unit.

3. The device of claim 1, comprising a control circuit controlling the movement of the cutting unit.

4. The device of claim 1, comprising a ridge formed around a top perimeter of the cutout.

5. The device of claim 1, wherein the slot is formed through the "U" shape depression into the base, the slot of sufficient depth to allow the cutting blade to enter the interior of the nipple and penetrate through the nipple forming the opening while not contacting the base.

6. The device of claim 5, wherein the slot is formed through the "U" shape depression into the base, the slot extending through a bottom area of the base.

7. The device of claim 1, wherein the support device comprises:

a base unit coupled to and extend up from the platform; and a sliding unit movably coupled to the base unit and securing the shaft in an upright position with the cutting blade extending in a downward position.

8. The device of claim 7, wherein the sliding unit comprises:

a body section slidable on the base unit;

a holding unit attached to the body section securing the shaft in an upright position with the cutting blade extending in a downward position;

an alignment plate extending out and perpendicular to the holding unit; and a "U" shaped slot formed within the alignment plate, the "U" shaped slot securing the shaft there within.

9. The device of claim 1, comprising a sliding device coupled to the platform, the sliding device moving the holding device from a first position on a first end of the sliding device to a second position directly below the cutting unit.

10. The device of claim 9, wherein the sliding device comprises:

a track running along a width of the platform;

a plate member slidably coupled to the track, the holding device coupled to the plate member.

11. The device of claim 9, wherein the driving device is coupled to the sliding device.

12. The device of claim 1, comprising a control circuit, wherein the control circuit has a pair of activation buttons, the pair of activation buttons being depressed together to power the cutting unit.

13. The device of claim 12, wherein the control circuit comprises an emergency shut off button.

14. The device of claim 1, wherein the "U" shaped depression limits deformation by holding and limiting a top of the nipple where the opening is formed from extending downward when the cutting blade penetrating the interior wall of the nipple where the opening is to be formed and extends into the slot.

* * * * *